US007021265B2

(12) United States Patent
Leweux et al.

(10) Patent No.: US 7,021,265 B2
(45) Date of Patent: Apr. 4, 2006

(54) UNIT CARRIER AND INTERNAL COMBUSTION ENGINE

(75) Inventors: Johannes Leweux, Esslingen (DE); Jürgen Schäfer, Remshalden (DE); Hubert Schnüpke, Stuttgart (DE); Dietmar Schröer, Remseck (DE); Nico Siebert, Leonberg (DE); Karsten Unger, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/877,857

(22) Filed: Jun. 25, 2004

(65) Prior Publication Data

US 2005/0000482 A1 Jan. 6, 2005

(30) Foreign Application Priority Data

Jun. 27, 2003 (DE) ..... 103 29 134

(51) Int. Cl.
*F02P 1/00* (2006.01)

(52) U.S. Cl. ..... 123/195 A

(58) Field of Classification Search ..... 123/195 A, 123/198 R, 195 C, 198 E, 195 R, 41.44, 123/90.27, 90.31, 90.38
See application file for complete search history.

(56) References Cited

U.S. PATENT DOCUMENTS

| | | | | |
|---|---|---|---|---|
| 2,875,746 | A * | 3/1959 | Brice et al. | 123/195 A |
| 3,730,147 | A * | 5/1973 | Buchwald | 123/41.44 |
| 5,687,690 | A * | 11/1997 | Kamiyama et al. | 123/198 R |
| 5,692,466 | A * | 12/1997 | Hausmann et al. | 123/195 A |
| 5,915,494 | A * | 6/1999 | Matsumura et al. | 180/232 |
| 6,244,239 | B1 | 6/2001 | Sisco et al. | |

FOREIGN PATENT DOCUMENTS

DE 195 43 350 C1 11/1996

* cited by examiner

*Primary Examiner*—Henry C. Yuen
*Assistant Examiner*—Hyder Ali
(74) *Attorney, Agent, or Firm*—Collard & Roe, P.C.

(57) ABSTRACT

A unit carrier for secondary units of a motor vehicle internal combustion engine, having secondary unit attachment devices and engine block attachment devices. The unit carrier has a planned deformation point, which allows a relative displacement between the secondary unit and the engine block in case of a vehicle collision, if a predefined force is exceeded. The unit carrier is used in motor vehicles having a front engine arrangement.

16 Claims, 1 Drawing Sheet

UNIT CARRIER AND INTERNAL COMBUSTION ENGINE

BACKGROUND OF THE INVENTION

1. Field of the Invention

The present invention relates to a unit carrier for secondary units of a motor vehicle internal combustion engine, having secondary unit attachment devices and engine block attachment devices. The invention also relates to an internal combustion engine for a motor vehicle having at least one secondary unit and one secondary unit carrier.

2. The Prior Art

A unit carrier for an internal combustion engine, which has secondary unit attachment devices and engine block attachment devices, is known from German Patent No. DE 195 43 350 C1. The unit carrier attaches a generator to the internal combustion engine. The secondary unit carrier is attached to a face of the internal combustion engine, and is formed by the control housing-cover. The secondary unit carrier is reinforced by means of a carrier structure that is arranged in a framework manner between the holders for the secondary units and has cross-ribs and struts connected with them. By means of the arrangement of the cross-ribs and struts, an extremely rigid control housing cover is created, by way of which an introduction of force of the secondary units into the motor housing can take place.

SUMMARY OF THE INVENTION

It is therefore an object of the invention to improve the crash behavior of motor vehicles. According to the invention, a unit carrier for secondary units of a motor vehicle internal combustion engine, having secondary unit attachment devices and engine block attachment devices, is provided. The unit carrier has a planned deformation point which allows a relative displacement between the secondary unit and the engine block in case of a vehicle collision, if a pre-defined force on a secondary unit is exceeded.

By providing a planned deformation point, a block formation of secondary units and engine block in case of a crash is avoided, and the risk of penetration of the engine block into the passenger compartment of the motor vehicle is reduced. In this connection, block formation refers to the behavior of the engine with the secondary units as a single, rigid structure, which is displaced as a whole in case of a crash, without absorbing any impact energy. With the unit carrier according to the invention, in case of a crash, the engine block and secondary units can be displaced, relative to one another. This increases the deformation possibilities of a motor vehicle and, in case of a crash, more energy can be absorbed by car body parts or other components, by avoiding the block formation.

In one embodiment of the invention, the planned deformation point is formed between the secondary unit attachment devices and the engine block attachment devices.

In this manner, the planned deformation point can be formed independent of the configuration of the secondary unit attachment devices and the engine block attachment devices. This facilities the use of conventional secondary units and conventional engine blocks. Furthermore, in the case of a less severe vehicle collision, it can be assured that the secondary units and the engine block remain essentially undamaged, and merely the unit carrier has to be replaced.

In addition, the planned deformation point is preferably configured as a planned breakage point. By means of these measures, part of the impact energy can be dissipated by having the unit carrier shear off at planned breakage points provided for this purpose, and a great displacement between the secondary unit and the engine block is made possible by having the unit carrier shear off. In this case, the secondary unit can be prevented from freely flying around, for example by additionally securing the secondary unit with a strap, or by securing the secondary unit with the drive belt or a drive chain, which is provided in any case.

In a further development of the invention, the planned deformation point is configured such that in case of a vehicle collision, controlled deformation of the planned deformation point and dissipation of impact energy takes place, with a relative displacement between the secondary unit and the engine block. In this manner, the unit carrier can support controlled energy dissipation in case of a collision.

The invention also includes an internal combustion engine having at least one secondary unit and one secondary unit carrier, wherein a front delimitation of the unit carrier and/or the at least one secondary unit lies in front, relative to a front delimitation of the engine block, seen in a collision direction to be expected here.

By means of such target placement of the unit carrier and/or the secondary units in front, early contact of the combination of engine block and secondary units with the other party in the accident is produced. In this manner, the internal combustion engine can participate in the delay at an earlier point in time, and dissipation of energy can take place via displacement of the entire internal combustion engine, or also by means of a deformation of the unit carrier. In this connection, the planned deformation point of the unit carrier can be designed in different ways, so that either the unit carrier is deformed or shears off before any displacement of the engine block, or the unit carrier is deformed or shears off only after displacement of the engine block and a further increase in forces. In each case, block formation of the engine block and secondary units during the collision is avoided, and the risk of penetration of the engine block into the interior is reduced. Because energy also can be dissipated by the unit carrier according to the invention during a collision, the surrounding car body parts can be designed to be lighter, for example, since they no longer have to absorb the complete impact energy.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
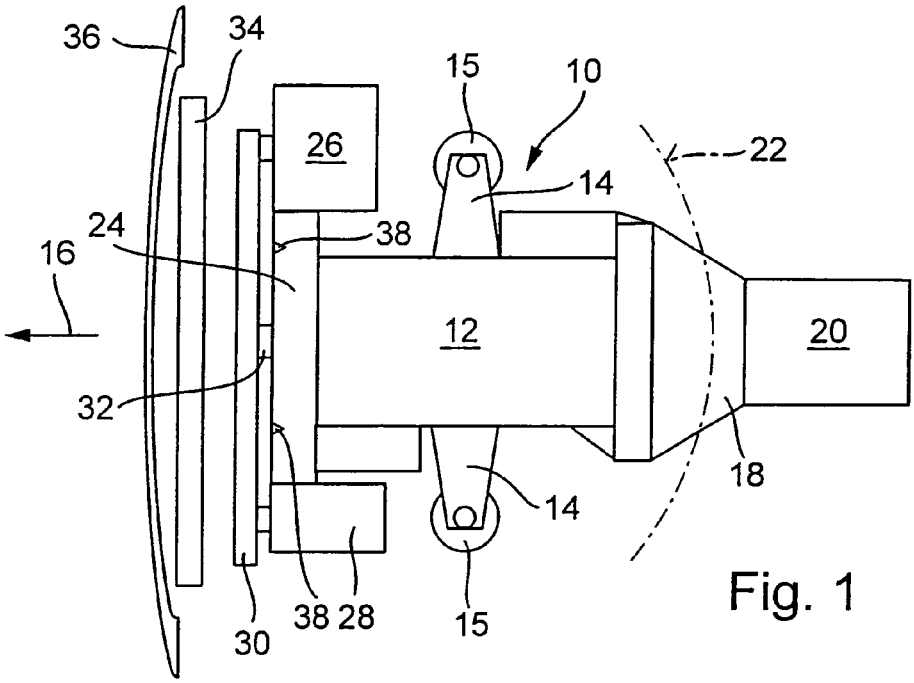
FIG. 1 shows a schematic top view of an internal combustion engine according to the invention, in the installed state, with a unit carrier.

Referring now in detail to the drawings, FIG. 1 schematically shows an internal combustion engine 10 having an engine block 12, which is connected with a motor vehicle by two engine bearings 14. A forward travel direction of the motor vehicle is indicated by arrow 16. Opposite forward travel direction 16, a clutch bell 18 and a transmission 20 follow engine block 12. The internal combustion engine 10 is arranged in an engine space (not shown) of the motor vehicle. Bearing points 15 that are fixed on the car body are indicated, and a rear delimitation of the engine space is represented by the indicated contour 22 of a water tank. Opposite the forward travel direction 16, a vehicle interior follows contour 22 of the water tank.

Seen in the forward travel direction 16, a unit carrier 24 is attached to one face of engine block 12, with several secondary units attached to this carrier, for example a generator 26 and a refrigerant compressor 28. Generator 26 and refrigerant compressor 28 are driven by a drive belt 30, which in turn is driven by a pulley arranged on a crankshaft continuation 32.

Seen in forward travel direction 16, a radiator 34 follows drive belt 30, and a front delimitation of the motor vehicle is formed by a front part structure, indicated schematically.

Unit carrier 24 is configured so that the secondary units, namely generator 26 and refrigerant compressor 28, seen in the forward travel direction 16, are arranged on the side, next to engine block 12. In this connection, both generator 26 and refrigerant compressor 28 are arranged at a distance from engine block 12, by means of the unit carrier 24, so that a relative movement of generator 26 and refrigerant compressor 28, relative to engine block 12, is possible in case of a crash, as will be explained in more detail below. Unit carrier 24 is provided with two planned breakage points 38 that are merely indicated schematically in FIG. 1, by means of a notch. Planned breakage points 38 are arranged approximately at the level of the lateral delimitations of engine block 12, seen in the forward travel direction 16. As will be described below, unit carrier 24 can thereby shear off in the region of planned breakage points 38, and generator 26 and/or refrigerant compressor 28 can be displaced opposite travel direction 16, together with the broken piece of unit carrier 24 that is attached to them.

Unit carrier 24 is furthermore configured so that seen in forward travel direction 16, a front delimitation of the secondary units, namely generator 26 and refrigerant compressor 28, is located in front, relative to a front delimitation of engine block 12. A front delimitation of generator 26 or refrigerant compressor 28 is formed by a pulley, in each instance, by way of which drive belt 30 runs and drives a shaft of generator 26 or refrigerant compressor 28, in each instance. In the representation according to FIG. 1, the front delimitation of generator 26 and refrigerant compressor 28 is placed in front of engine block 12, proceeding from the front delimitation of the latter, by approximately a quarter of its length, in the forward travel direction 16. In this connection, the forward placement is chosen to be so great that a noteworthy dissipation of energy can already take place by means of unit carrier 24 deforming or shearing off in case of a collision. Because of the energy dissipation by unit carrier 24, the surrounding car body parts can therefore be relieved of stress in case of a collision, and can be made lighter, if necessary.

Figure 2:
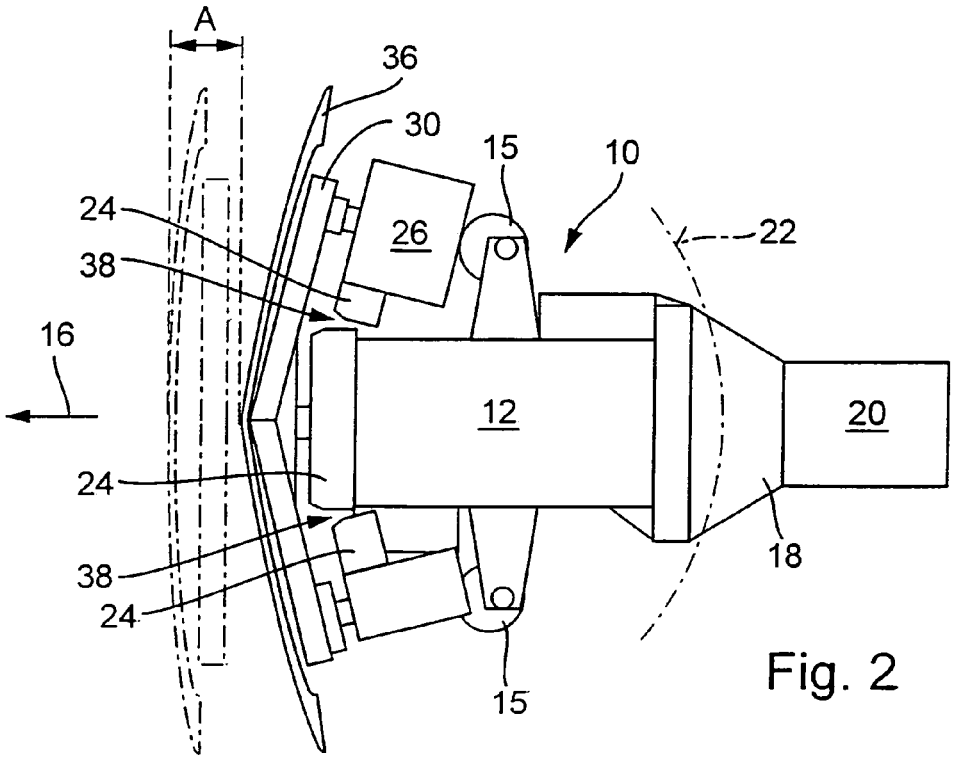
FIG. 2 shows a schematic representation of the internal combustion engine of FIG. 1, after a vehicle collision.

The schematic representation of FIG. 2 shows the internal combustion engine 10 of FIG. 1 after a vehicle collision. Here, the front part structure 36 has been displaced by a deformation path A opposite forward travel direction 16. The original position of front part structure 36 and radiator 34 is indicated by dot-dash lines in FIG. 2.

As a result of the displacement of front part structure 36 by deformation path A, engine block 12 has also been displaced towards the vehicle interior, by a (smaller) distance. This can be seen, for example, by the position of the motor bearings 14 relative to the fixed bearing points 15 on the car body, which has been displaced towards the rear in FIG. 2, as well as by the position of engine block 12, clutch bell 18, and transmission 20, which position has been displaced relative to contour 22 of the water tank.

In FIG. 2, unit carrier 24 has sheared off in the region of its two planned breakage points 38, so that both generator 26 and refrigerant compressor 28 were able to be displaced, seen opposite the forward travel direction 16. In this connection, both generator 26 and refrigerant compressor 28 have not only been displaced opposite forward travel direction 16, but have also performed a rotational movement, approximately about the center of unit carrier 24. In FIG. 2, generator 26 and refrigerant compressor 28 are now only connected with engine block 12 by way of drive belt 30. Guidance of drive belt 30 on generator 26 and refrigerant compressor 28, respectively, can be implemented in such a way that generator 26 and refrigerant compressor 28, respectively, with the broken piece of unit carrier 24 attached to them, are prevented from flying around. As an alternative, unit carrier 24 can be configured so that instead of a planned breakage point, a planned deformation point is provided, and even after a vehicle collision, the secondary units are securely held on engine block 12, by means of unit carrier 24, which is then deformed.

In total, it is evident from FIGS. 1 and 2 that because of the forward placement of generator 26 and refrigerant compressor 28, relative to engine block 12, the internal combustion engine 10 can already participate in a collision delay at an early point in time, and that energy dissipation by means of deformation of unit carrier 24 can already take place at an early point in time during the collision, because the secondary units are placed in front and because planned breakage points 38 are provided on unit carrier 24. Furthermore, by providing planned breakage points 38 on unit carrier 24, block formation of engine block 12 and generator 26 as well as the refrigerant compressor 28 is avoided, so that compared with the total deformation path A, a relatively low penetration depth of internal combustion engine 10 in the direction of the vehicle interior occurs.

Accordingly, while only a few embodiments of the present invention have been shown and described, it is obvious that many changes and modifications may be made thereunto without departing from the spirit and scope of the invention.

What is claimed is:

1. A unit carrier for secondary units of a motor vehicle internal combustion engine, comprising:

secondary unit attachment devices;

engine block attachment devices; and at least one planned deformation point comprising an area of the unit carrier having a reduced thickness as compared to the rest of the unit carrier, such that when the vehicle is involved in a collision, the unit carrier is deformed and the secondary unit and an engine block of the internal combustion engine are displaced relative to one another when a predefined force on a secondary unit is exceeded.

2. A unit carrier according to claim 1, wherein the planned deformation point is formed between the secondary unit attachment devices and the engine block attachment devices.

3. A unit carrier according to claim 1, wherein the planned deformation point is a planned breakage point.

4. A unit carrier according to claim 1, wherein the planned deformation point is formed between the secondary unit and the engine block so that in case of a vehicle collision a the secondary unit rotates about a center of the unit carrier and creates a controlled deformation of the planned deformation point and dissipation of impact energy.

5. The unit carrier according to claim 1, wherein the planned deformation point is a notch.

6. The unit carrier according to claim 1, wherein the planned deformation point is arranged at a level of a lateral delimitation of the engine block.

7. The unit carrier according to claim 1, wherein there are two secondary unit attachment devices, each of said secondary unit attachment devices being disposed on an opposite side of the engine block attachment device from the other secondary unit attachment device.

8. An internal combustion engine for a motor vehicle, comprising:

at least one secondary unit;

one secondary unit carrier having at least one planned deformation point, formed between the at least one secondary unit and an engine block, such that when the vehicle is involved in the collision, the unit carrier is deformed at the deformation point and the secondary unit and the engine block of the internal combustion engine are displaced relative to one another when a predefined force on a secondary unit is exceeded, wherein a front delimitation of the unit carrier or of the at least one secondary unit is placed in front of a front delimitation of the engine block when viewed in an expected collision direction.

9. The internal combustion engine according to claim 8, wherein there are two secondary units, each secondary unit being disposed on an opposite side of the engine block from the other secondary unit.

10. The internal combustion engine according to claim 8, wherein the planned deformation point is a notch.

11. The internal combustion engine according to claim 8, wherein the planned deformation point is arranged at a level of a lateral delimitation of the engine block.

12. An internal combustion engine for a motor vehicle, comprising:

at least one secondary unit;

one secondary unit carrier having at least one planned deformation point comprising an area of the unit carrier having a reduced thickness as compared to the rest of the unit carrier, such that when the vehicle is involved in the collision, the unit carrier is deformed at the deformation point and the secondary unit and an engine block of the internal combustion engine are displaced relative to one another when a predefined force on a secondary unit is exceeded, wherein a front delimitation of the unit carrier or of the at least one secondary unit is placed in front of a front delimitation of the engine block when viewed in an expected collision direction.

13. The internal combustion engine according to claim 12, wherein there are two secondary units, each secondary unit being disposed on an opposite side of the engine block from the other secondary unit.

14. The internal combustion engine according to claim 12, wherein the planned deformation point is a notch.

15. The internal combustion engine according to claim 12, wherein the planned deformation point is arranged at a level of a lateral delimitation of the engine block.

16. An internal combustion engine according to claim 12, wherein the planned deformation point is formed between the secondary unit and the engine block so that in case of a collision, the secondary unit rotates about a center of the unit carrier and creates a controlled deformation of the planned deformation point and dissipation of impact energy.

* * * * *